United States Patent [19]

Baumer

[11] 4,137,662

[45] Feb. 6, 1979

[54] DEFLECTABLE PARKING SPACE RESERVATION INDICATOR

[76] Inventor: Walter Baumer, 2304 NW. 7th Pl., Miami Beach, Fla. 33127

[21] Appl. No.: 858,443

[22] Filed: Dec. 7, 1977

[51] Int. Cl.[2] ..... G09F 7/00

[52] U.S. Cl. ..... 40/612; 40/608

[58] Field of Search ..... 404/6, 10; 116/63 R; 40/608, 612, 584, 606

[56] References Cited

U.S. PATENT DOCUMENTS

| | | | |
|---|---|---|---|
| 1,776,447 | 9/1930 | Parkhurst | 40/612 X |
| 2,290,695 | 7/1942 | Marcus | 116/63 P |
| 3,235,214 | 2/1966 | Sprung | 40/612 X |
| 3,851,616 | 12/1974 | Brown | 40/612 X |
| 4,019,271 | 4/1977 | Latimer | 40/607 X |
| 4,038,769 | 8/1977 | Werner | 40/612 |

*Primary Examiner*—Russell R. Kinsey
*Assistant Examiner*—Wenceslao J. Contreras
*Attorney, Agent, or Firm*—Erwin M. Barnett

[57] ABSTRACT

A sign serving as a deterrent to unauthorized parking is mounted on a post which is resiliently supported by a base in a normal vertical position and is adapted to be deflected into an inclined position by the car bumper when overriding the base in driving head-in into the parking space. The base has a vertical wall which guides the post in returning from the inclined to the normal vertical position preventing rearward deflection and has an open front shaped to permit the forward deflection of the post through a predetermined horizontal angle. An axial helical tension spring for a tubular post or a spring biased pivot for a channel shaped post connects the respective post to the base for the resilient deflectability.A wire slide-guard is mounted along the post spaced from the sign to engage the car bumper and any protruding portions of the undercarriage for smooth passage therealong to facilitate the deflection and prevent the sign from locking thereon when the car backs out of the parking space. As an alternative form of slide-guard, the sign is shaped in a concave configuration and formed with a curved, beaded, periphery for engagement with the car bumper.

11 Claims, 11 Drawing Figures

DEFLECTABLE PARKING SPACE RESERVATION INDICATOR

BACKGROUND OF THE INVENTION

1. Field of the Invention

This invention relates to signs for discouraging unauthorized parking in individual parking spaces, such as those assigned specifically to tenants in apartment buildings, to apartment owners in condominiums, to tenants in office buildings and to company employees, and more particularly is directed to such signs, each having a supporting post resiliently retained in a normal vertical position on a base provided for mounting within the individual parking space area to obstruct complete access by the car thereto, the supporting post being deflectable from the vertical position to an inclined position by bumper contact as the car, in driving head-on into the parking space, overrides the base.

2. Description of the Prior Art

Parking barrier devices for preventing unauthorized use of individually assigned parking spaces, particularly of the head-in angle or perpendicular arrangement, are known to comprise a base for pivotally anchoring the barrier to the pavement and means including a lock and key for retaining the barrier in an upright vertical operative position, the barrier extending to a height sufficient to obstruct access by a car to the individual parking space. When unlocked, the barrier may be pivoted to a horizontal position substantially along the pavement permitting the car to freely override the base and barrier without contacting the bumper or undercarriage. The device also usually includes bracing means for reinforcing the barrier in its vertical operative position and a special foundation for anchoring the base, both of which contribute to the cost of the device and to its installation.

While providing positive protection against unauthorized use of a parking space, these lock and key barriers, in addition to being subject to serious damage and distortion from the impact by cars, either accidently or purposely, have another objectionable disadvantage, namely, the inconvenience of having to get out of the car before entering the parking space, unlocking the device and manually repositioning the barrier to its horizontal position, getting back into the car and driving into the parking space. Likewise, when leaving, after pulling out of the parking space it is necessary to again get out of the car, erect and lock the barrier and get back into the car. There is also the burden of keeping track of the key or remembering the combination.

SUMMARY OF THE INVENTION

Among the objects of the invention is to provide signs and supporting post structures therefor as reservation indicators for private or assigned individual parking spaces in parking lots or garages, each capable of easy installation on the pavement of such individual spaces as a visible obstruction to unauthorized parking and which shall be removable without excessive damage to the pavement. Each reservation indicator in serving as a deterrent shall resemble the positive, locked, individual parking space barriers but shall obviate the various disadvantages thereof as hereinbefore described. The reservation indicator shall be inexpensive to manufacture and capable of being shipped in a knock-down condition and easily assembled for installation, shall comprise a post giving a solid appearance yet be deflectable by the front bumper of the car when driving into the parking space without causing any damage to the indicator, bumper or the undercarriage of the car.

The private parking space reservation indicator comprises a sign affixed to the upper end of a post standing about waist high, a base having a horizontal flat plate for attaching to the pavement of the parking space in a location requiring overriding by the front end of a car when driving into the parking space, means mounted on the plate resiliently supporting the post in a normally upright vertical position, and a slide-guard adapted to be contracted and ridden along by the front bumper of the car during the overriding to effect deflection thereof permitting the car to completely enter the parking space and to prevent the sign and post from catching onto the car bumper and undercarriage when the car backs out of the parking space and the post returns to its vertical position. The base includes means for guiding the post in its deflection and return to vertical position wherein the sign is faced in a desired predetermined direction.

One form of slide-guard for use with a flat sign comprises a wire-like rod attached at opposite, rearwardly bent, ends thereof to opposite end portions of the post and extending longitudinally at a spaced distance in front of the post to span the sign. Another form of slide-guard is substantially integral with the sign which is fashioned in a concave oval configuration having a curved, beaded periphery positioned for engagement by the bumper.

Two forms of posts and resilient mountings therefor are contemplated, one utilizing a tubular post with an axially connected helical tension spring, the other utilizing a channel shaped post pivoted at the lower end on a horizontal axis and spring biased for the resilient deflection from vertical to inclined positions.

DESCRIPTION OF THE PREFERRED EMBODIMENTS

Figure 1:
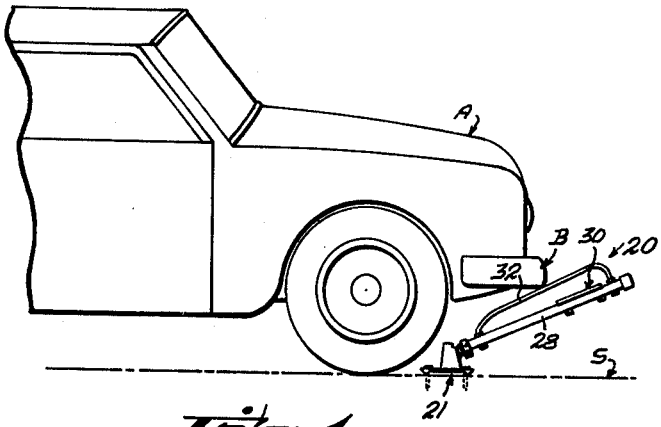
FIG. 1 is a fragmentary side elevational view of a car parked in a space in which the reservation indicator embodying the invention is installed showing the bumper operatively contacting the slide-guard and deflecting the post and sign to an inclined position to accommodate parking of the car.
Figure 2:
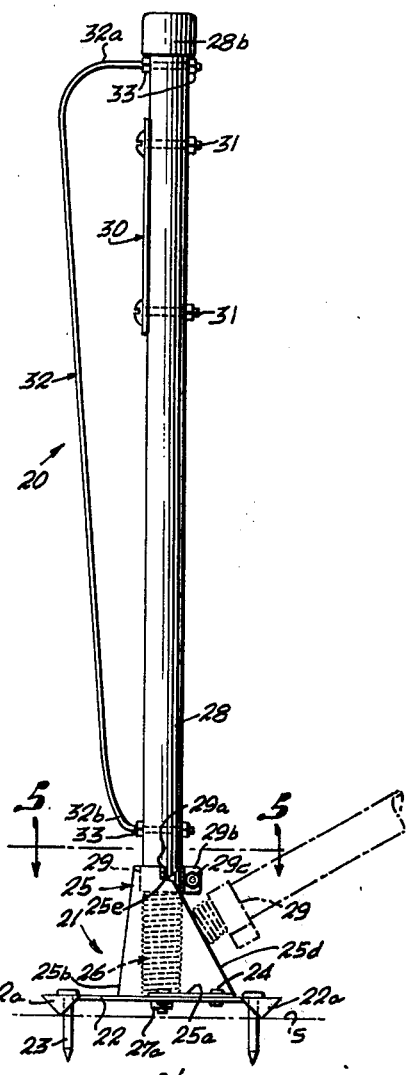
FIG. 2 is a side elevational view of the reservation indicator as installed in a parking space in normal upright position, the lower end of the post being indicated in broken lines in deflected position as by the parked car shown in FIG. 1.
Figure 3:
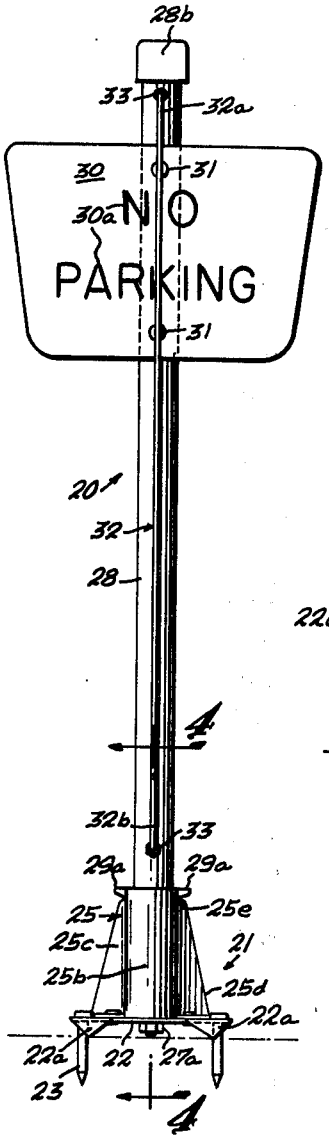
FIG. 3 is a front elevational view of the reservation indicator shown in FIG. 2.
Figure 4:
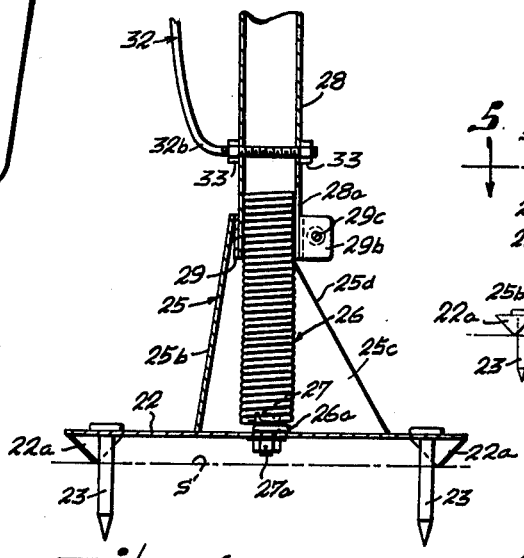
FIG. 4 is an enlarged vertical sectional view taken on line 4—4 in FIG. 3 showing details of construction.
Figure 5:
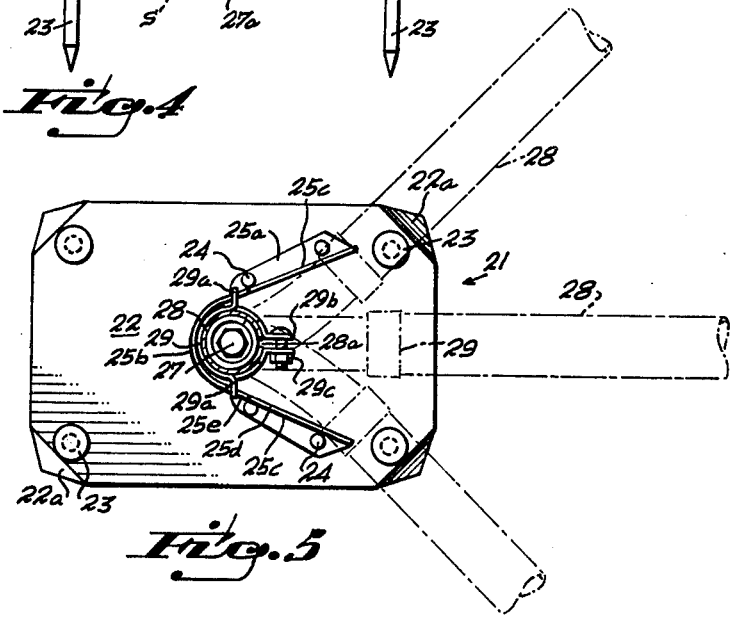
FIG. 5 is an enlarged sectional view taken on line 5—5 in FIG. 2, the lower end of the post being indicated in broken lines in a centrally and two extreme laterally deflected positions.

Referring in detail to the drawings, 20 generally denotes a personalized parking space reservation indicator, constructed to embody the invention, seen in FIGS. 2 to 5, inclusive, to comprise a base 21 resiliently supporting a post 28 in a normally vertical upright position displaying sign 30 which is secured to the upper end thereof, and a slide-guard 32 extending along post 28 in front of sign 30.

Base 21 is seen to comprise a flat plate 22, adapted to extend horizontally and be anchored to the pavement of the parking space, and a vertical housing 25 suitably secured to plate 22, as by rivets 24 extending through openings in plate 22 which align with openings formed in the pair of opposite horizontal flanges **25*a* extending from the bottom of housing 25. Plate 22 may be rectangular in shape and has each of the four corners 22*a* bent downwardly to provide four point contact with the pavement for stability and to space plate 22 a slight distance above pavement surface S to accommodate various downwardly projecting fastening means and irregularities in the pavement. Suitable openings are formed in plate 22 inwardly of corners 22*a* to receive therethrough anchoring spikes 23 which extend into the pavement. Vertical housing 25 has a curved front wall 25*b* substantially centralized on plate 22 and lateral sidewalls 25*c*** diverging therefrom to provide a wide open rear.

Post 28, being of tubular stock, has an upper end cap **28*b* and carries sign 30 spaced downwardly therefrom a sufficient distance for slide-guard 32 to provide the intended protection. Sign 30, having lettering 30*a* providing an appropriate warning message on the front facing surface thereof, is suitably attached to post 28, as by bolt and nut fasteners 31, the orientation of the front facing surface of sign 30, likewise, determining the front side of post 28 and dictates the alignment thereof with base 21 and vertical housing 25. Post 28 has the lower end thereof coaxially mounted on helical tension spring 26 which is connected to vertically upstand from the center of base plate 22 concentrically surrounded on the front side thereof by curved front wall 25*b* of vertical housing 25. Whereas the parts may be connected by welding, however, to facilitate shipping in a knock-down condition and for ease of assembly, post 28 and spring 26 are sized for the latter to telescope into the lower end of post 28 and be secured therein by clamping collar 29 having radially extending end flanges 29*b* formed with aligned openings for adjustable clamping therethrough by nut and bolt 29*c*. A short longitudinal slot 28*a* at the telescoped end portion of post 28 permits tightening of the latter around the telescoped end of spring 26 in the well understood manner. Tension spring 26 has a lower end coil 26*a* of reduced diameter through which bolt 27 axially extends and by nut 27*a* fastens the spring 26 and post 28 assembly to plate 22** in the normal vertical position and for deflection as hereinafter described.

Vertical housing 25, in addition to enhancing the appearance of base 21 and concealing spring 26 from the view of drivers of cars entering and leaving the parking area, also serves as a guide for post 28 in its deflection and return to vertical position. To achieve this purpose, lateral diverging sidewalls **25*c* have sloping side edges 25*d* which extend downwardly and rearwardly from lateral notches 25*e* at the top of curved front wall 25*b* to plate 22. Lateral notches 25*e* are diametrically aligned and are each cut downwardly from the top edge of curved front wall 25*b* and located for engagement by diametrically extending tabs 29*a* which may be cut from clamping collar 29** and bent into proper diametric alignment.

Slide-guard 32 may be suitably attached to extend longitudinally along substantially the length of post 28 at a spaced distance therefrom. As here shown, slide-guard 32 is made of rod stock having upper and lower end portions **32*a* and 32*b*, respectively, bent at right angles to pass through diametric openings in post 28, the upper opening being located just below cap 28*b* and spaced above sign 30, the lower opening being located adjacent to collar 29 above and close to vertical housing 25. The ends of portions 32*a* and 32*b* are threaded to receive pairs of spaced nuts 33 for tightening against opposite sides of post 28 as attachment means for slide-guard 32. Upper end portion 32*a* is relatively longer than lower end portion 32*b* to position the upper part of slide-guard 32 farther away from post 32 in the region of sign 30** for the purpose hereinafter more fully described.

The practical utility and operation of reservation indicator 20 will now be apparent. Base 21 is anchored to the pavement of an individual parking space by spikes 23 at a position centered on the longitudinal centerline with the plane of sign 30 orientated at right angles thereto and wherein post 28 extends in a normal vertical position at about 2½ feet inward of the front end of the space, or, stated in other terms, at a location sufficiently close to the front end of the space so that bumper B will not lose contact with slide-guard 32 by passing beyond upper end portion **32*a* when car A is properly parked. In this location post 28 and sign 30, nevertheless, present an apparent obstruction to proper parking, and with the message on sign 30** admonishing unauthorized parking constitutes a significant deterrent to the unauthorized driver.

As car A drives into the parking space, bumper B will contact a lower portion of slide-guard 32 and sliding therealong, by the flexing of spring 26, will deflect post 28 rearwardly with respect to sign 30, which is in the direction toward the front end of the parking space, to an inclined position as seen in FIG. 1. Occasionally, when driving into the parking space, the front of car A will approach post 28 in a curved path either from the right or left and consequently bumper B will strike slide-guard 32 at an angle rather than squarely head-on. In this eventuality, the initial impact will rearwardly deflect post 28 through a relatively small angle but sufficiently to cause tabs **29*a* to clear notches 25*e*. Thereafter, the divergency of lateral sidewalls 25*c* and the slope of side edges 25*d* of housing 25 will permit limited lateral deflection of post 28 as indicated in broken lines in FIG. 5 to accommodate this angular approach of car A. The size and keystone shape with rounded corners of sign 30 and the spacing of slide-guard 32 therefrom cooperate in avoiding any contact by sign 30 with bumper B or the undercarriage of car A to prevent catching or snagging thereon while entering or leaving the parking space. In backing out of the parking space, bumper B slides along slide-guard 32 in a reverse direction releasing post 28, which under the action of spring 26 and guided by lateral sidewalls 25*c* and edges 25*d* thereof returns to the vertical position abutting the upper border of curved front wall 25*b* of vertical housing 25 and is axially rotationally orientated to properly align sign 30 by the engagement of diametric tabs 29*a* in notches 25*e***.

The invention also contemplates a spring biased horizontal pivot as an alternative form of deflective mounting which is shown in FIGS. 8 to 11, inclusive, incorporated in reservation indicator 50 having a base 51 comprising flat plate 52 with turned down corners **52*a* and suitable openings for anchoring spikes 53, all being similar to plate 22, corners 22*a* and spikes 23 of base 21**.

Figure 10:
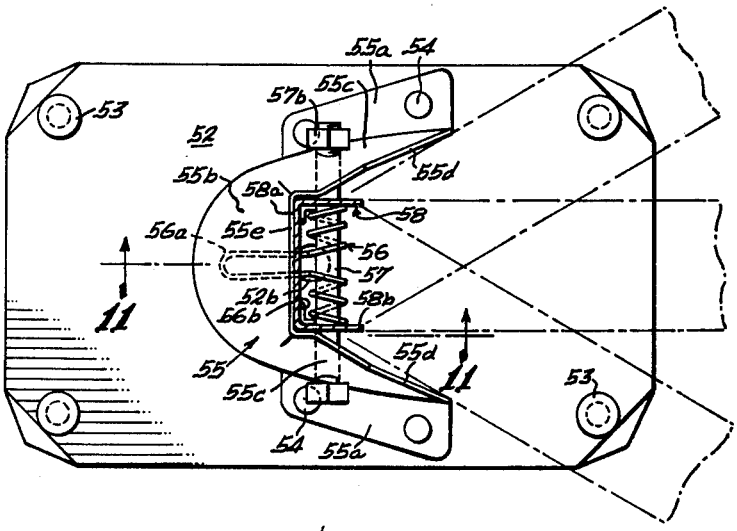
FIG. 10 is a sectional view taken on line 10—10 in FIG. 9, the lower end of the post being indicated in broken lines in a centrally and two extreme laterally deflected positions.
Figure 11:
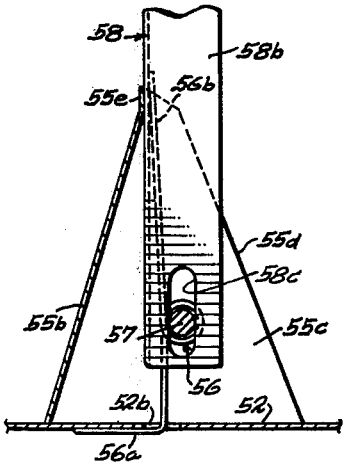
FIG. 11 is a sectional view taken on line 11—11 in FIG. 10 showing the slots in the channel sidewalls permitting the lateral deflection of the post.

A vertical housing 55 is secured to plate 52 by rivets 54 extending through horizontal flanges **55*a* and has a curved front wall 55*b* with a flaired bottom tapering upwardly to a U-shaped top border 55*e* and a pair of diverging sidewalls 55*c* having side edges 55*d* sloping downwardly from border 55*e* to plate 52, as seen in FIGS. 10 and 11**.

Post 58 of reservation indicator 50 is formed of channel-shaped stock, being better adaptable to the pivotal mounting thereof than the tubular stock of post 28, and comprises a front facing panel **58*a* between opposite sidewalls 58*b*. Sign 60, having lettering 60*a* of a warning message on a front facing surface thereof, is suitably attached to front facing panel 58*a* of post 58 at a spaced distance from the upper end thereof to be protectively spanned by slide-guard 62. The latter, being similar in shape to slide-guard 32, has rearwardly bent and threaded opposite ends for mounting in openings in panel 58*a* by pairs of nuts 63 in a manner similar to the mounting of slide-guard 32 on post 28**.

A pivot for post 58 is provided by a bolt 57 secured between opposite lateral sidewalls **55*c* by nut 57*b* to extend on a horizontal axis spaced above plate 52 and to pass through aligned elongated slots 58*c* formed longitudinally in the lower ends of channel sidewalls 58*b* which may be spaced from sidewalls 55*c* by washers 57*a*. Also mounted on bolt 57 between channel sidewalls 58*b* is a coiled spring 56 which resiliently retains post 58 in the normal vertical upright position nested in U-shaped top border 55*e* of curved front wall 55*b*, border 55*e* conforming to the shape of post 58, which when in nested engagement therein is prevented from normally assuming a lateral tilt. Coiled spring 56 exerts a tension between base plate 52 and post 58 to retain the latter in vertical position by being formed with an elongated L-shaped midportion 56*a* extending beyond the lower end of post 58 and through opening 52*b* in plate 52 to engage the bottom thereof and a pair of straight spring portions 56*b* extending from opposite ends of spring 56 along the interior of post 58 engaging the rear of panel 58*a***.

Reservation indicator 50 generally functions in a manner similar to indicator 20 as hereinbefore described. Thus, as slide-guard 62 is connected by bumper B, post 58 is deflected by pivoting on bolt 57 against the tension of spring 56. When the deflective force of bumper B has a lateral component, as when the approach of car A is in a curved path, the initial impact dislodges post 58 from its nested position in U-shaped border **55*e*, freeing the former for limited lateral deflection, as indicated in broken lines in FIG. 10. Such lateral deflection is facilitated by elongated slots 58*c*, which permit angular shifting of post 58 with respect to the axis of bolt 57, and diverging sidewalls 55*c* and the sloping side edges 55*d* thereof. Upon release, spring 56 returns post 58 to a vertical position guided by sloping side edges 55*d*, if laterally deflected, and into nested engagement in U-shaped border 55*e* of curved front wall 55*b*. The bottom flairing of front wall 55*b* provides sufficient clearance for the lower end of post 58 permitting deflection approaching the horizontal and particularly when limited lateral deflection causes longitudinal shifting in slots 58*c***.

Figure 6:
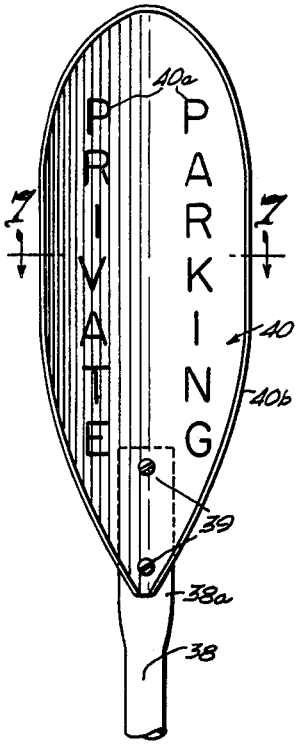
FIG. 6 is a fragmentary front elevational view of a modified sign and post construction embodying the invention wherein the slide-guard is incorporated in the structural configuration and beaded edge of the sign.
Figure 7:
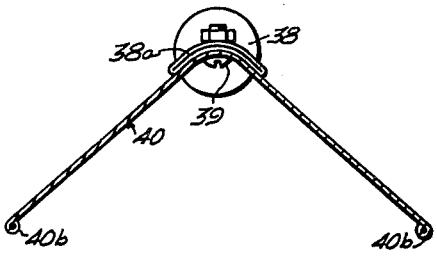
FIG. 7 is a sectional view taken on line 7—7 in FIG. 6 showing the concave configuration and beaded edge of the sign.
Figure 9:
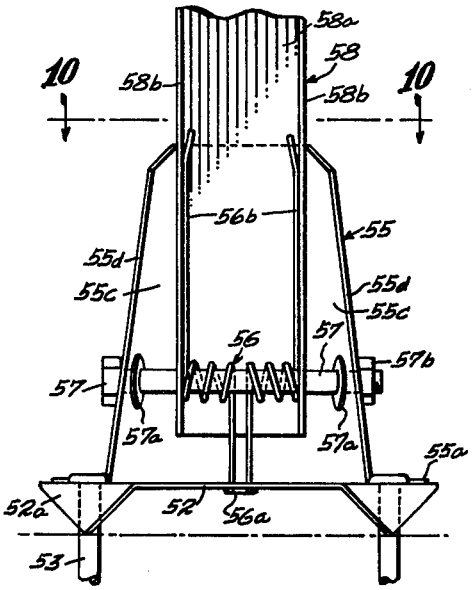
FIG. 9 is a fragmentary enlarged rear elevational view of the base of the modified embodiment shown in FIG. 8 showing details of the pivotal mounting of the post.
Figure 8:
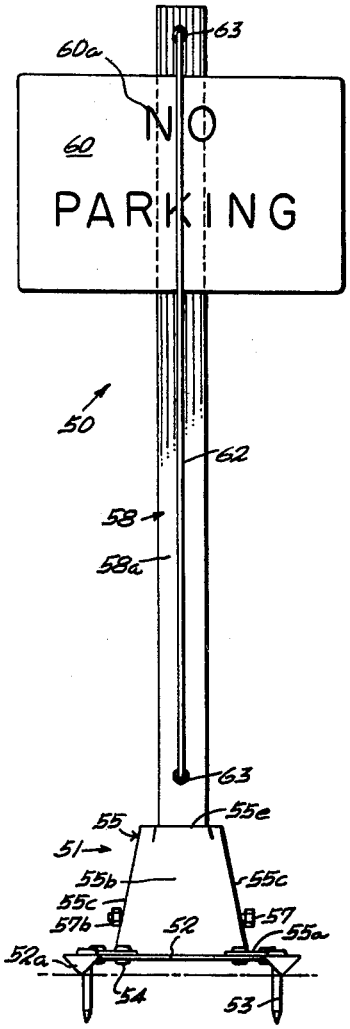
FIG. 8 is a front elevational view of another modified embodiment of the invention wherein the post is channel-shaped and mounted on the base for pivotal deflection on a horizontal axis.

The invention further contemplates a modified form of slide-guard which is adaptable to both the helical spring mounting of reservation indicator 20 and the pivoted mounting of indicator 50. Such slide-guard is an integral part of the post and sign rather than being the separate element which slide-guards 32 and 62 constitute and its construction is shown in FIGS. 6 and 7 as sign 40 which is oval in shape, concave along the major axis, has a finished beaded edge **40*b*, has lettering 40*a* of a warning message on the front facing concave surface thereof, and is mounted as an extension on the upper end of a relatively short post 38. As herein shown, post 38 is of tubular stock with the upper end 38*a* flattened and shaped to conform to the axial concavity of sign 40 and is secured thereto by suitable screw and nut fasteners 39. Likewise, sign 40 may be mounted to terminate a short post made of channel-shaped stock similar to post 58**.

In use, short post 38 and sign 40 are sized and positioned with respect to the front end of the parking space so that bumper B initially contacts and slides along post 38 while deflecting the latter and then easily enters upon and slides along the beaded edge **40*b* of sign 40 without overriding the upper end thereof in a manner similar to bumper B not overriding upper end portion 32*a* of slide-guard 32**.

It will also be apparent that short post 38 may be of so short a length and sign 40 of a relatively long major axis so that bumper B will only make contact with and slide along the beaded edge **40*b*** during deflective engagement therewith.

For better viewing at night, lettering **30*a*, 40*a* and 60*a* of signs 30, 40 and 60, respectively, may be phosphorescent and various decorative phosphorescent markings, such as stripes and borders (not shown) may be affixed to the posts and bases of reservation indicators 20 and 50**.

Although post 58 is shown and described as channel-shaped and having an open rear facing side, the latter may be closed, as by the use of tubular stock of rectangular cross-section instead of the channel stock. Reference to the channel-shape of the post in the claims following should therefore be interpreted to include such tubular construction.

The parking space reservation indicators herein disclosed are seen to achieve the several objects of the invention and to be well adapted to meet conditions of practical use. As various possible embodiments might be made of this invention, and as various changes might be made in the disclosed reservation indicators, it is to be understood that all matters herein set forth or shown in the accompanying drawings are to be interpreted as illustrative and not in a limiting sense.

What is claimed is:

1. A reservation indicator for an individual parking space comprising a sign having a front facing surface bearing a message and being affixed to an upper end of a post resiliently supported in a normally upright vertical position, a base having a horizontal plate for attaching to the pavement of the parking space in a location requiring overriding by the front end of a car and deflection of the post from said vertical position to an inclined position, means mounted on said plate for said resilient support of said post, and slide-guard means associated with said post and sign adapted to be contacted and ridden along by the front bumper of the car during said overriding to effect said deflection permitting the car to completely enter said parking space and to prevent the sign and post from catching onto the car bumper and undercarriage when the car backs out of the parking space and the post returns to said vertical position.

2. The reservation indicator defined in claim 1 in which said slide-guard includes a sign having a concave configuration and a smooth finished edge prominently disposed for contacting said bumper.

3. The reservation indicator defined in claim 1 in which said post has an upper end projecting above said sign, and said slide-guard comprises a rod extending longitudinally at a spaced distance in front of the post and sign, said rod having upper and lower opposite ends bent rearwardly, said upper bent end being attached to the post above said sign and the lower bent end attached to the post at a spaced distance below the sign.

4. The reservation indicator defined in claim 1 in which said means for resilient support of the post includes a helical tension spring mounted in axial alignment with said post to vertically upstand from said horizontal plate.

5. The reservation indicator defined in claim 1, a vertical housing mounted on said horizontal plate having a curved front wall surrounding the front facing side of said post, said curved front wall having an upper border against which said post abuts as a stop in said vertical position, said vertical housing having lateral diverging sidewalls with sloping side edges for guiding said post to and from deflected positions and permitting limited lateral rearward movement.

6. The reservation indicator defined in claim 5 in which said post is channel-shaped and comprises a front facing panel between opposite sidewalls, a pair of elongated, aligned slots longitudinally extending adjacent the lower end of said opposite sidewalls, said means for resilient support of the post including a horizontal pivot pin extending between and supported by said vertical housing lateral sidewalls at a spaced distance above said horizontal base plate and through said elongated slots of said post, and a coiled spring coaxially mounted on said pin between said post opposite sidewalls and having portions extending to engage said base plate and post applying resilient spring pressure therebetween.

7. The reservation indicator defined in claim 6 in which said curved front wall upper border has a configuration corresponding to said post into which the latter nests for vertical orientation when returning from a limited lateral deflection under the action of said spring.

8. The reservation indicator defined in claim 1 in which said post is tubular and has a short longitudinal slot extending upwardly from the lower end thereof, and said means for resilient support of the post includes a helical tension spring mounted to vertically upstand from said horizontal plate and has an upper end telescoping into the lower end of said tubular post in the region of said slot, and an adjustable clamping collar on said telescoped post lower end tightening the latter on said spring.

9. The reservation indicator defined in claim 5 in which opposite ends of said curved front wall merge with the upper end of each of said sloping side edges in diametrically positioned notches, said means for resilient support of the post including a helical tension spring mounted in axial alignment with said post to vertically upstand from said horizontal plate, and a pair of tabs diametrically extending from said post located to engage said notches when in said vertical upright position to rotationally orientate said sign in a front facing position as said post is returned from a deflected position by said spring.

10. The reservation indicator defined in claim 9 in which said axial alignment mounting of said post on said spring comprises a telescoping connection of the upper end of the spring into the lower end of said post, and a clamping collar tightening said telescoping connection, said pair of tabs being integrally formed as cutout and bent portions of said collar.

11. The reservation indicator defined in claim 1 in which said horizontal base plate is substantially rectangular in shape and has four corners bent downwardly to provide four point contact with said parking space pavement, an opening inwardly of each of said bent corners, and an anchoring spike extending through each opening into the pavement as said attachment thereto.

* * * * *